US010724519B2

(12) United States Patent
Andreis et al.

(10) Patent No.: US 10,724,519 B2
(45) Date of Patent: Jul. 28, 2020

(54) ELASTIC CONTAINMENT ASSEMBLY FOR A PUMP

(71) Applicant: FLUID-O-TECH S.R.L., Corsico (MI) (IT)

(72) Inventors: Vittorio Andreis, Milan (IT); Gabriele Sorrentino, Milan (IT)

(73) Assignee: FLUID-O-TECH S.R.L., Corsico (MI) (IT)

( * ) Notice: Subject to any disclaimer, the term of this patent is extended or adjusted under 35 U.S.C. 154(b) by 37 days.

(21) Appl. No.: 15/447,273

(22) Filed: Mar. 2, 2017

(65) Prior Publication Data

US 2017/0254329 A1 Sep. 7, 2017

(30) Foreign Application Priority Data

Mar. 2, 2016 (IT) ..... 202016000022022

(51) Int. Cl.
*F04C 15/00* (2006.01)
*F04B 53/16* (2006.01)
(Continued)

(52) U.S. Cl.
CPC ..... *F04C 15/0042* (2013.01); *F04B 53/16* (2013.01); *F04C 2/18* (2013.01);
(Continued)

(58) Field of Classification Search
CPC ..... F04C 11/008; F04C 15/0015; F04C 15/0019; F04C 15/0023; F04C 15/0042;
(Continued)

(56) References Cited

U.S. PATENT DOCUMENTS 2,665,641 A * 1/1954 Lauck ..... F03C 2/08 417/283
2,996,015 A * 8/1961 Prasse ..... F04C 15/0026 418/135
(Continued)

FOREIGN PATENT DOCUMENTS

EP 2143935 A1 * 1/2010 ..... F02M 59/06
EP 2273121 A2 * 1/2011 ..... F04C 2/086
(Continued)

*Primary Examiner* — Alexander B Comley
(74) *Attorney, Agent, or Firm* — King & Schickli, PLLC

(57) ABSTRACT

A containment assembly for a pump provided with at least one pumping group and with 5 at least one power transmission system to such a pumping group. The containment assembly includes a substantially cylindrical containment vessel provided with an opening at one of the ends thereof, configured to at least 10 partially enclose the pumping group and the respective power transmission system. The containment assembly also includes at least one closure plate, sealably coupled with the containment vessel at the open end thereof and configured to hermetically enclose, in 15 cooperation with such a containment vessel, the pumping group and the respective power transmission system. On a predetermined contact portion between the containment vessel and the closure plate at least one wave spring is provided, configured to keep the pumping group 20 dynamically under compression by means of the closure plate.

11 Claims, 3 Drawing Sheets

(51) Int. Cl.
*F04C 2/18* (2006.01)
*F04C 2/08* (2006.01)
*F04C 2/14* (2006.01)
*F04B 17/03* (2006.01)

(52) U.S. Cl.
CPC ..... *F04C 15/0023* (2013.01); *F04B 17/03* (2013.01); *F04C 2/086* (2013.01); *F04C 2/14* (2013.01); *F04C 15/008* (2013.01); *F04C 15/0015* (2013.01); *F04C 15/0019* (2013.01); *F04C 2240/30* (2013.01); *F04C 2270/46* (2013.01)

(58) Field of Classification Search
CPC ..... F04C 15/0069; F04C 15/008; F04C 2240/30; F04C 2270/46; F04C 2/18; F04C 2/086; F04C 2/14; F04C 15/0026; F04B 17/03; F04B 53/16
USPC ..... 418/131–135
See application file for complete search history.

(56) References Cited

U.S. PATENT DOCUMENTS 5,076,770 A * 12/1991 Dabling ..... F04C 2/088 418/1
2014/0105776 A1* 4/2014 Ellero ..... F04C 15/0026 418/191

FOREIGN PATENT DOCUMENTS

EP 2273121 A2 1/2011
EP 2538082 A2 * 12/2012 ..... F04C 2/14

* cited by examiner

ELASTIC CONTAINMENT ASSEMBLY FOR A PUMP

The disclosure of Italian Utility Model Application No. 202016000022022 is incorporated herein by reference.

TECHNICAL FIELD

The present invention refers to an elastic containment assembly for a pump, in particular but not exclusively a positive displacement pump having inner or outer gears.

BACKGROUND

As known, a positive displacement pump is a particular type of pump that exploits the change in volume in a chamber to cause either a suction or a thrust on an incompressible fluid. Positive displacement pumps include rotary pumps of the gear type, in which the change in volume of the work chamber is obtained through the rotation of elements, typically two toothed wheels that engage with one another, capable of delimiting rotary chambers having variable volume. Gear pumps are widely used in the field of lubrication and, in general, in all applications in which the liquid to be transferred is particularly viscous.

For example, so-called inner gear pumps are built with the two gears arranged one inside the other but on offset axes. A separation assembly takes care of separating the two gears by means of a half-moon shaped dividing wall. The depression caused by the movement of the gears, when the respective teeth move apart, allows liquid to enter into the cavity that is created between the teeth of the gears themselves. When, on the other hand, the teeth of the gears approach one another, an overpressure is created that pushes the liquid towards the discharge area of the pump.

In gear pumps, the transmission of power, generated normally by an electric motor, can take place through so-called "magnetic drive". This transmission system is provided with two coaxial magnetic rings or cores, mounted one on the drive shaft and the other on the shaft of the impeller, in other words one of the gears of the pump. By applying a torque, the magnetic fields of the core mounted on the drive shaft move towards those of equal polarity of the core mounted on the shaft of the impeller and, through the effect of magnetic repulsion, push it into rotation.

Currently, the components and the power transmission systems of the most common gear pumps are enclosed by sealed containment vessels made of metallic material, typically stainless steel. A cost-effective solution for the packing of these components and the closure of the pump consists of bending the plate of a containment shield on the body of the pump, for example through cold deformation (vertical pressing or lateral rolling).

If the pump is operating at particularly low temperatures and if it is subjected to more or less long periods of inactivity, it is possible for there to be increases in volume of the liquid to be pumped due to the freezing of the liquid itself. The fact that it is impossible for the sealed containment vessel of the pump to compensate for such increases in volume may therefore cause damage to the internal mechanisms of the pump itself.

Document EP 2273121 A2, filed to the same Applicant, describes a containment assembly for a pump configured to compensate for possible increases in volume of the liquid contained inside the pump itself. However, as well as these increases in volume, during the normal operation of the pump excessive tolerances or "clearances" can also be generated between the moving components of the pump itself. These clearances are due mainly to thermal dilations of the components of the pump that occur in opposite work conditions to those mentioned above, in other words in the case of high temperatures. Irrespective of the causes, these clearances can in any case compromise the correct operation of the pump.

SUMMARY

The general purpose of the present invention is therefore to make an elastic containment assembly for a pump that is capable of solving the aforementioned drawbacks of the prior art in an extremely simple, cost-effective and particularly functional manner.

In detail, a purpose of the present invention is to make an elastic containment assembly for a pump that is capable of at least partially recovering the inner clearances of the pump itself in the case of volumetric expansions of the pumped fluid, due to low temperatures.

Another purpose of the invention is to make an elastic containment assembly for a pump that is capable of at least partially recovering the inner clearances of the pump itself in the case of thermal dilations of the components of the pump itself, due to high temperatures.

A further purpose of the invention is to make an elastic containment assembly for a pump that is capable of keeping the inner components of the pump itself dynamically at the correct compression.

These purposes according to the present invention are accomplished by making an elastic containment assembly for a pump as outlined in claim 1.

Further characteristics of the invention are highlighted by the dependent claims, which are an integral part of the present description.

BRIEF DESCRIPTION OF THE DRAWINGS

The characteristics and advantages of an elastic containment assembly for a pump according to the present invention will become clearer from the following description, given as an example and not for limiting purposes, referring to the attached schematic drawings, in which.

Figure 1:
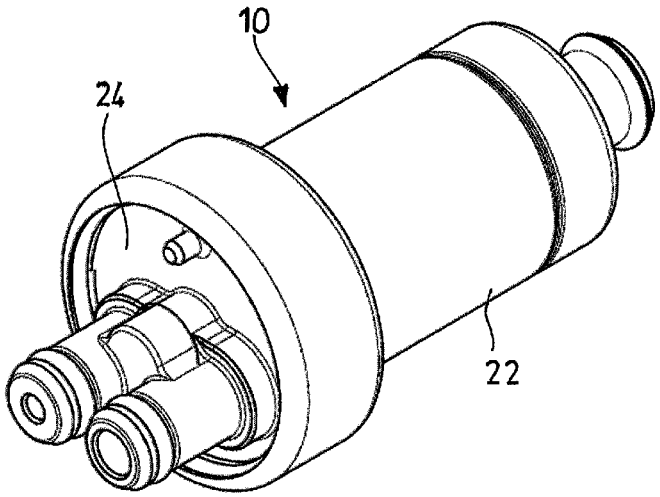
FIG. 1 is a perspective view that illustrates a first embodiment of an elastic containment assembly for a pump made according to the present invention.

It should be specified that, in the attached figures and in the following description, numerous components of the pump will not be mentioned and/or illustrated, since they are components that are well known to a person skilled in the art.

DETAILED DESCRIPTION

With reference to the figures, an elastic containment assembly for a pump made according to the present invention is shown, wholly indicated with reference numeral 10. The containment assembly 10 is configured to be mounted on a generic pump internally provided with at least one pumping group and with at least one power transmission system to such a pumping group.

In the embodiment shown in the figures, the pump is of the geared positive displacement type and the respective pumping group comprises, in a per se known way, a first gear 12, free to rotate on a first fixed shaft 16, and a second gear 14, free to rotate on a second fixed shaft 18. Alternatively, again in a per se known way, each gear 12 and 14 could be fitted onto the respective shaft 16 and 18 or, in other words, could be fixedly connected to the respective shaft 16 and 18. The first shaft 16 and the second shaft 18 are on different but mutually parallel axes, so that the first gear 12 can engage with the second gear 14. Therefore, during the rotation of the first gear 12 with respect to the second gear 14, the unjoining of the teeth of the two gears 12 and 14 causes the suction of the liquid inside the pump, whereas the joining back together causes the delivery of the liquid itself.

On the first shaft 16, as well as the first gear 12, the power transmission system is also fitted, said system consisting in this case of a magnet 20 actuated by a typically electric motor. The containment assembly 10 thus comprises a substantially cylindrical containment vessel 22 provided with an opening at one of the two ends thereof. The containment vessel 22 is preferably made of metallic material and is configured to at least partially enclose the pumping group and the respective power transmission system. The containment assembly 10 also comprises at least one closure plate 24, sealably coupled with the containment vessel 22 at the open end thereof and configured to hermetically enclose, in cooperation with such a containment vessel 22, the pumping group and the respective power transmission system.

According to the present invention, on a predetermined contact portion between the containment vessel 22 and the closure plate 24 there is at least one wave spring 26 having a single coil, preferably manufactured in metallic material and configured to keep the pumping group dynamically under compression by means of the closure plate 24. The wave spring 26 thus makes it possible to absorb possible thermal dilations of the components of the pumping group due, for example, to temperature variations, at all times ensuring a certain degree of compression.

Preferably, on the aforementioned predetermined contact portion between the containment vessel 22 and the closure plate 24 there is also a contrast ring 28. The contrast ring 28 is arranged in direct contact with the wave spring 26 and is in abutment against a specific wall of the containment vessel 22, in this case the circumferential edge of the open end of such a containment vessel 22, as will be specified more clearly hereinafter. The contrast ring 28, also manufactured preferably in metallic material, is thus configured to ensure a rigid support for the wave spring 26. Again preferably, the wave spring 26 is arranged between the contrast ring 28 and the closure plate 24.

The wave spring 26 is preferably circular, just as the cross section of the containment vessel 22 and of the closure plate 24 is also circular, and it has a rectangular cross section. The outer diameter of the wave spring 26 is substantially equal to the inner diameter of the containment vessel 22 and to the outer diameter of the closure plate 24.

Figure 2:
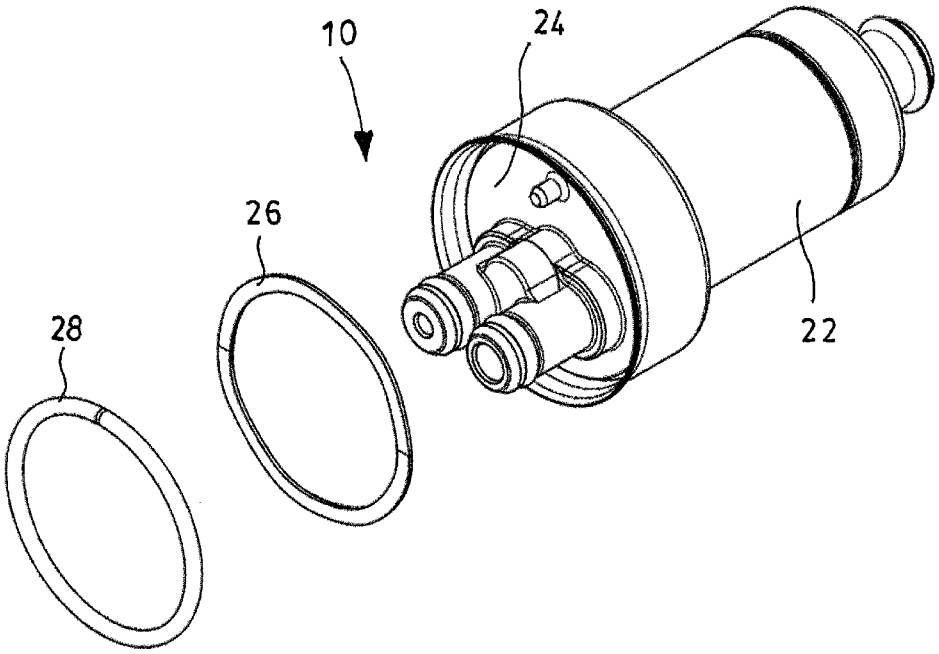
FIG. 2 is a perspective view of the containment assembly of FIG. 1, shown in partially assembled configuration.

The final assembly step of the containment assembly 10 is shown in FIG. 2. The assembly foresees a preliminary step of introducing the pumping group and the respective power transmission system in the containment vessel 22. It is thus foreseen to mount the closure plate 24 on the containment vessel 22. At this point, firstly the wave spring 26 and then the contrast ring 28 are applied in sequence on the closure plate 24, as shown in FIG. 2.

Figure 3:
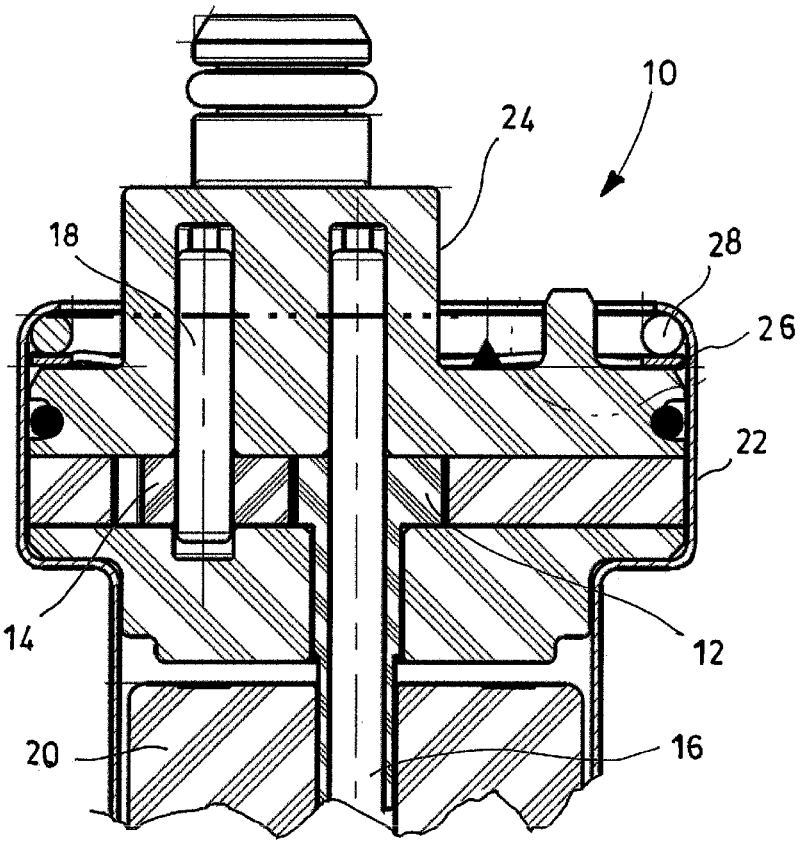
FIG. 3 is a section view of the containment assembly of FIG. 1.
Figure 4:
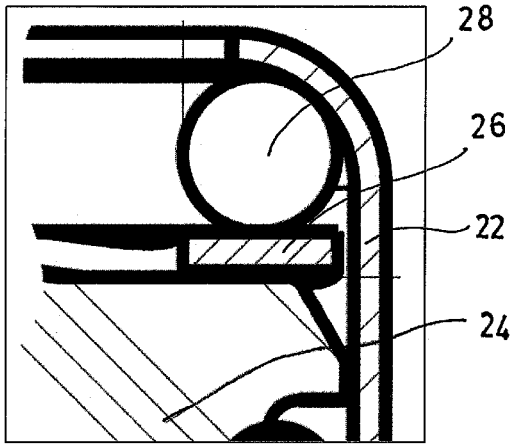
FIG. 4 shows an enlarged detail of the section view of FIG. 3.
Figure 5:
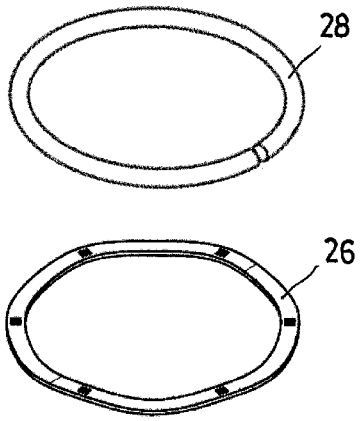
FIG. 5 is a perspective view of two components of the containment assembly of FIG. 1.

Once the wave spring 26 and the contrast ring 28 have been correctly installed, the circumferential edge of the open end of the containment vessel 22 is bent over the closure plate 24, about the contrast ring 28 (FIGS. 3 and 4), thus exploiting the rigid support provided by such a contrast ring 28 and compressing the wave spring 26.

Figure 6:
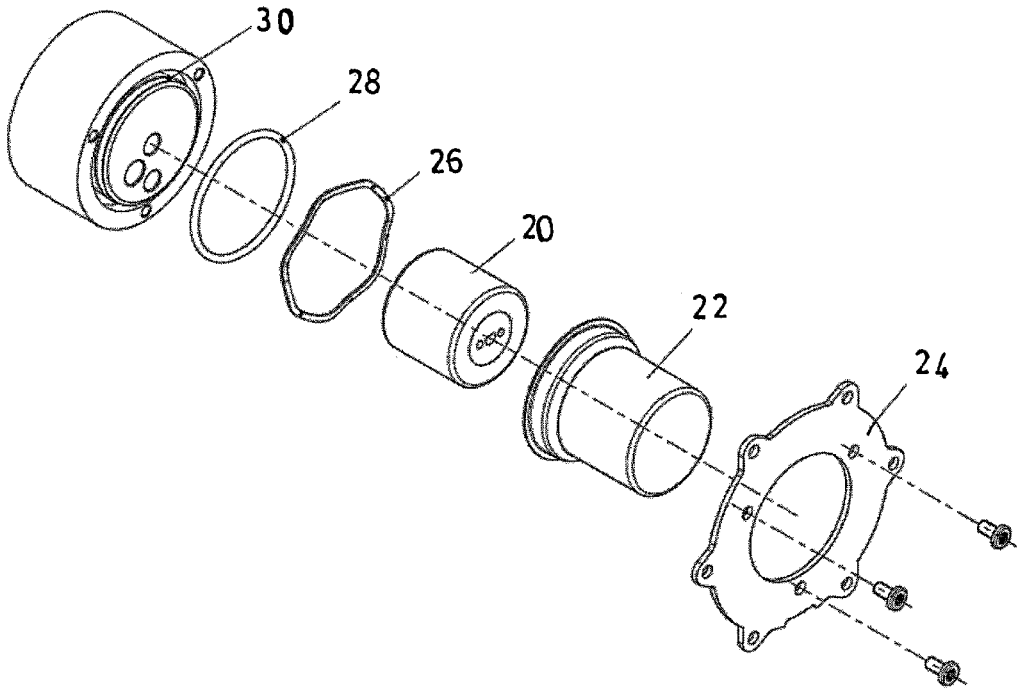
FIG. 6 is an exploded view that illustrates a second embodiment of an elastic containment assembly for a pump made according to the present invention.
Figure 7:
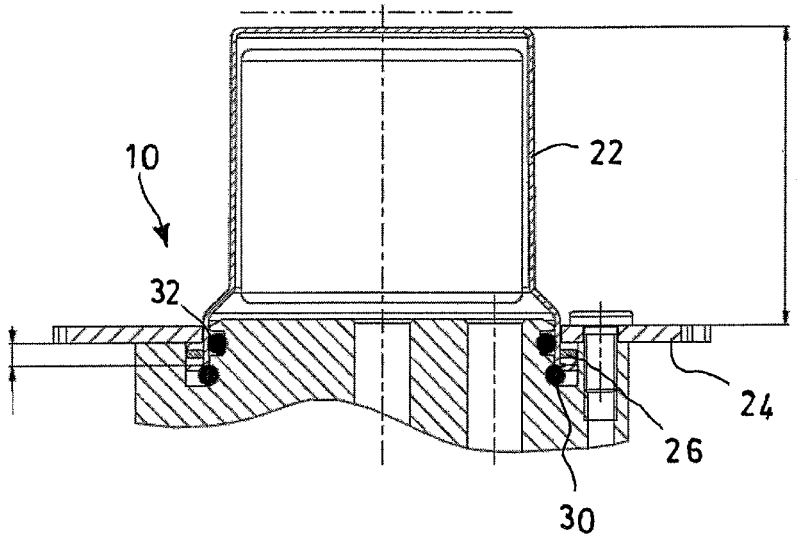
FIG. 7 is a section view of the containment assembly of FIG. 6.

FIGS. 6 and 7 illustrate a second embodiment of the containment assembly 10 according to the present invention. In this embodiment the closure plate 24 consists of a fixed flange, in other words able to be fixed to a predetermined structure through known fixing means. The containment vessel 22, on the other hand, consists of a floating shield configured to move axially, thanks to the presence of the wave spring 26, with respect to the fixed flange 24. Depending on the morphology of the wave spring 26, this axial movement can also have a significant stroke with respect to the overall dimensions of the pump.

In addition to the wave spring 26 and a first sealing ring 30, of the O-ring type and having the function of damping the stroke end abutment, between the floating shield 22 and the fixed flange 24 a second sealing ring 32, again of the O-ring type, is also arranged. This second embodiment of the containment assembly 10 has been specifically designed for the volumetric compensation of the fluid pumped in the case of temperatures lower than the freezing point of the fluid itself.

It has thus been seen that the elastic containment assembly for a pump according to the present invention achieves the purposes highlighted previously. As well as ensuring a rigid support during the closure of the pump that makes it possible to obtain a radial profile, such a containment assembly indeed constitutes an elastic system capable of keeping the components of the pump, typically manufactured in plastic material, dynamically under compression. This technical provision makes it possible to absorb possible thermal dilations of the components of the pump due to temperature increases, at all times ensuring a certain degree of compression. In the same way, the elastic system is capable of absorbing volumetric expansions of the fluid pumped during the freezing steps. In the absence of an outer elastic system of this type, it would be improbable to be able to absorb significant volumetric changes of the fluid (for example, the increase in volume during the freezing step) with only the introduction of an element inside the pump with a "bearing" function. Finally, it is important to emphasise that, once the external stresses have been removed, the elastic system restores the original pre-tensioning state of the components of the pump.

The elastic containment assembly for a pump thus conceived can in any case undergo numerous modifications and variants, all of which are covered by the same innovative concept; moreover, all of the details can be replaced by technically equivalent elements. In practice, the materials used, as well as the shapes and sizes, can be whatever according to the technical requirements.

The scope of protection of the invention is therefore defined by the attached claims.

The invention claimed is:

1. A containment assembly (10) for a pump provided with at least one pumping group (12, 14, 16, 18) and with at least one power transmission system (20) for transmitting power to said pumping group, the containment assembly (10) comprising: a substantially cylindrical floating containment vessel (22) provided with a through opening at one of its two ends and a circumferential edge monolithically formed with said vessel, said floating containment vessel (22) being configured to at least partially enclose the pumping group (12, 14, 16, 18) and the respective power transmission system (20); and at least one fixed closure plate (24) configured to be fixed to a predetermined outer structure, said at least one fixed closure plate (24) sealably coupled with the floating containment vessel (22) at the end having the through opening and configured to hermetically enclose, in cooperation with said floating containment vessel (22), the pumping group (12, 14, 16, 18) and the respective power transmission system (20), the containment assembly (10) being characterised in that on a predetermined contact portion between the floating containment vessel (22) and the fixed closure plate (24) at least one wave spring (26) is provided, configured to keep the pumping group (12, 14, 16, 18) dynamically under compression by means of the fixed closure plate (24), said at least one wave spring (26) allowing relative axial movement between said floating containment vessel (22) and said fixed closure plate (24) to absorb possible thermal dilations of components of the pumping group (12, 14, 16, 18) or to absorb volumetric expansions of a pumped fluid, and further characterised in that the circumferential edge of said floating containment vessel (22) at said through opening is bent over said fixed closure plate (24), said at least one wave spring (26) being provided on a contact portion between said circumferential edge of said floating containment vessel (22) and said fixed closure plate (24).

2. The containment assembly (10) according to claim 1, characterised in that on said predetermined contact portion between the floating containment vessel (22) and the fixed closure plate (24) a contrast ring (28) is also provided, said contrast ring (28) being arranged in direct contact with the wave spring (26) and being in abutment against a specific wall of the floating containment vessel (22) to ensure a rigid support for said wave spring (26).

3. The containment assembly (10) according to claim 2, characterised in that the wave spring (26) is arranged between the contrast ring (28) and the fixed closure plate (24).

4. The containment assembly (10) according to claim 2, characterised in that the contrast ring (28) is manufactured of metallic material.

5. The containment assembly (10) according to claim 1, characterised in that the wave spring (26) is a single-coil spring.

6. The containment assembly (10) according to claim 1, characterised in that the wave spring (26) has a rectangle-shaped cross section.

7. The containment assembly (10) according to claim 1, characterised in that the wave spring (26) is manufactured of metallic material.

8. The containment assembly (10) according to claim 1, characterized in that the pumping group comprises a first gear (12), free to rotate on a first shaft (16), and a second gear (14), free to rotate on a second shaft (18), said first shaft (16) and second shaft (18) being on different but mutually parallel axes so that the first gear (12) can engage with the second gear (14).

9. The containment assembly (10) according to claim 1, characterised in that the power transmission system consists of a magnet (20) actuated by an electric motor.

10. The containment assembly (10) according to claim 1, characterised in that the fixed closure plate (24) consists of a fixed flange, whereas the floating containment vessel (22) consists of a floating shield configured to move axially, due to the presence of the wave spring (26), with respect to the fixed flange (24).

11. The containment assembly (10) according to claim 10, characterised in that between the floating shield (22) and the fixed flange (24), in addition to the wave spring (26), a first O-ring having the function of damping a stroke end abutment and a second O-ring are arranged.

* * * * *